US005592921A

United States Patent [19]

Rehbichler

[11] Patent Number: 5,592,921

[45] Date of Patent: Jan. 14, 1997

[54] METHOD AND DEVICE FOR ACTUATING AN ELECTROMAGNETIC LOAD

[75] Inventor: Gerhard Rehbichler, St. Johann, Austria

[73] Assignee: Robert Bosch GmbH, Stuttgart, Germany

[21] Appl. No.: 500,994

[22] PCT Filed: Nov. 29, 1994

[86] PCT No.: PCT/DE94/01416

§ 371 Date: Aug. 8, 1995

§ 102(e) Date: Aug. 8, 1995

[87] PCT Pub. No.: WO95/16118

PCT Pub. Date: Jun. 15, 1995

[30] Foreign Application Priority Data

Dec. 8, 1993 [DE] Germany ..... 43 41 797.3

[51] Int. Cl.[6] ..... F02M 51/00

[52] U.S. Cl. ..... 123/490

[58] Field of Search ..... 123/357, 490; 361/152, 154

[56] References Cited

U.S. PATENT DOCUMENTS

| | | | |
|---|---|---|---|
| 4,653,447 | 3/1987 | Linder et al. | 123/357 |
| 4,821,562 | 4/1989 | Inoue | 73/119 A |
| 4,841,451 | 6/1989 | Rumpf et al. | 364/484 |
| 4,970,622 | 11/1990 | Buchl | 123/490 |
| 4,978,865 | 12/1990 | Hartmann et al. | 123/490 |
| 5,022,374 | 6/1991 | Denz et al. | 123/490 |
| 5,251,091 | 10/1993 | Ito et al. | 123/490 |
| 5,277,163 | 1/1994 | Ohishi | 123/490 |

FOREIGN PATENT DOCUMENTS

| | | |
|---|---|---|
| 0242446 | 10/1987 | European Pat. Off. . |
| 3817770 | 11/1989 | Germany . |
| 3426799 | 5/1993 | Germany . |
| WO90/07188 | 6/1990 | WIPO . |

*Primary Examiner*—Willis R. Wolfe
*Attorney, Agent, or Firm*—Kenyon & Kenyon

[57] ABSTRACT

A method and a device for actuating an electromagnetic load, in particular a solenoid valve, for influencing the metering of fuel in a diesel internal combustion engine. The load is connected in series with a switching means which is supplied with an actuation signal. In order to identify a switching time of the electromagnetic load, a parameter which characterizes the actuation signal is evaluated.

11 Claims, 3 Drawing Sheets

METHOD AND DEVICE FOR ACTUATING AN ELECTROMAGNETIC LOAD

FIELD OF THE INVENTION

The present invention relates to a method and a device for actuating an electromagnetic load.

BACKGROUND INFORMATION

A method and a device for actuating an electromagnetic load is known from German Patent Application No. DE A 34 26 799 (corresponding to U.S. Pat. No. 4,653 447). In the device described in this publication, the switching times, and on the basis thereof the switch-on times and switch-off times of the solenoid valve, are detected. On the basis of the variation over time of the current through the solenoid valve, the precise switching time of the solenoid valve is determined.

Such solenoid valves are used preferably for controlling the injection of fuels in petrol engines and/or diesel engines. For exact metering of even extremely small quantities for injection in particular, the switching time at which the armature of the solenoid valve reaches one of its two limit positions is of interest.

In known systems, the procedure adopted is such that in a time window within which the switching time usually occurs, the current profile is evaluated and the switching time determined on the basis of its variation over time.

An object of the present invention includes indicating, with a method and a device for actuating an electromagnetic load, a possible means of determining the switching time with a low degree of expenditure.

SUMMARY OF THE INVENTION

With the method according to the present invention and the corresponding device for actuating an electromagnetic load, it is possible to determine the switching time with a low degree of expenditure.

DETAILED DESCRIPTION OF THE INVENTION

The exemplary embodiments according to the present invention include device for actuating electromagnetic loads, in particular in the field of fuel metering in a diesel internal combustion engine. In principle, the devices according to the present invention can be used in conjunction with any electromagnetic load. It is not restricted to the specific application described.

However, it is particularly advantageous to use the device according to the present invention in conjunction with internal combustion engines, in particular when metering fuel into a combustion space of the internal combustion engine. In this case, a solenoid valve can be used particularly advantageously for controlling the metering of fuel into the internal combustion engine. By actuating the solenoid valve, the start of injection, the end of injection, and thus the quantity of fuel injected, are determined.

In particular with small loads and high speeds of revolution, it is necessary for extremely small quantities for injection to be metered as exactly as possible. For this purpose it is in turn necessary that the time at which the armature of the solenoid valve reaches its limit position is known. This time is usually referred to as the switching time. This time can be acquired by evaluating the variation over time of the solenoid valve current.

Figure 1:
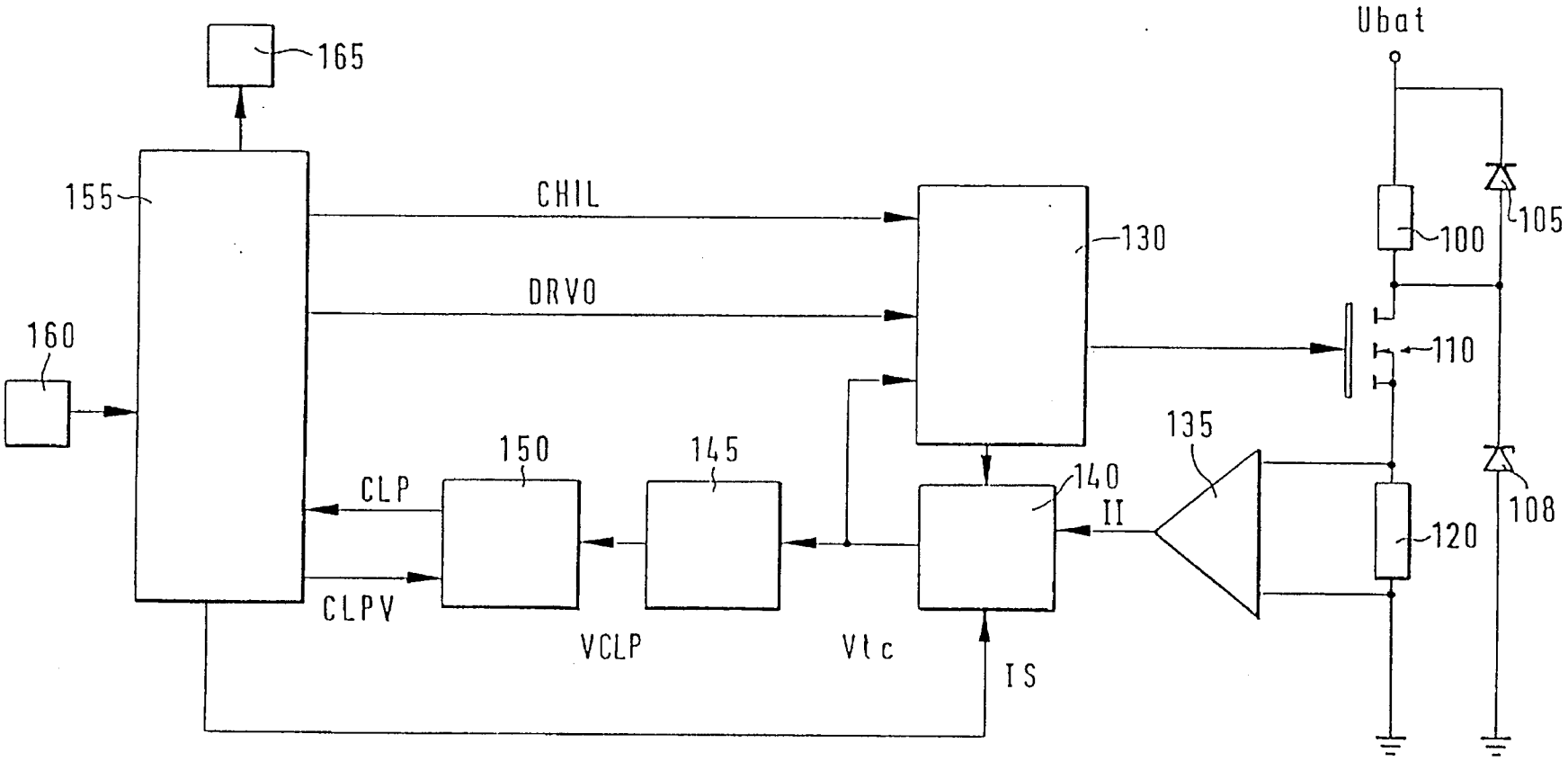
FIG. 1 shows a block diagram of the device according to the present invention.

In FIG. 1, the circuitry of the device according to the present invention is illustrated diagrammatically. Only the essential components are indicated. The positive pole Ubat of the battery is connected to ground via a series circuit comprising a load 100, in particular an electromagnetic load, a switching means 110 and a measuring device 120.

In addition, the positive pole of the battery voltage Ubat is connected to the cathode of a diode 105. The anode of the diode 105 is in contact with the connection point between the load 100 and the switching means 110. The anode of the diode 105 is connected to the cathode of a Zener diode 108. The anode of the Zener diode 108 is connected to ground.

The switching means 110 is supplied with control signals by an output stage 130. The two terminals of the measuring device 120 are connected to a current evaluating device 135. The current evaluating device 135 supplies a current controller 140 with an actual value II for the current. The current controller supplies the output stage 130 and a filter 145 with a signal Vtc. The filter 145 in turn supplies a time window 150 with a signal VCLP. The time window 150 passes on a signal CLP to a control unit 155.

The control unit 155 supplies the time window 150 with a signal CLPV. Furthermore, the control unit 155 supplies the current controller 140 with a desired value IS for the current. The control unit 155 is also connected to the output stage 130 and transmits the signals CHIL and DRVO to it. Furthermore, the output stage 130 is connected to the current controller 140 in order to transmit a signal. The control unit 155 detects the signals of various sensors 160 and supplies further elements 165 with various signals.

The arrangement of the load, the switching means 110 and the measuring device 120 is given in FIG. 1 only by way of example. They may also be arranged in another sequence. Thus, there may also be provision for the measuring device 120 to be arranged between the load 100 and the switching means 110. If the measuring device 120 is arranged between the electromagnetic load 100 and the switching means 110 or between the electromagnetic load 100 and the positive pole Ubat of the supply voltage, the current values can also be detected and evaluated after the switching means 110 opens.

The diode 105 serves as a free-wheeling circuit and constitutes the simplest way of implementing such a free-wheeling circuit. It may be replaced if appropriate by other switching elements such as for example a plurality of diodes connected in series or by a series circuit comprising a transistor and a diode. The same applies for the Zener diode 108, it serves as an extinguishing device and, if appropriate, it can be replaced, or supplemented, by other suitable components.

The switching means 110 is preferably a transistor, in particular a field-effect transistor. In the simplest case an ohmic resistor can be used as measuring device 120. In this case, the drop in voltage at the ohmic resistor serves as a measure of the current flowing through the series circuit comprising the load 100 and switching means 110.

This device will now be described with reference to an example of a fuel metering device of an internal combustion engine. The control unit 155 evaluates the signals of various sensors 160. The sensors 160 detect, for example, the engine speed, the position of the accelerator pedal, various temperature values and pressure values and, in particular in the case of internal combustion engines with spark ignition, the position of the throttle valve. On the basis of these sensor signals and characteristic operating parameters, the control unit 155 calculates various signals for actuating various final control elements 165.

Inter Alia, the control unit 155 prescribes a signal DRVO which determines the actuation period of the switching means 110. At the positive edge of the signal DRVO the switching means 110 closes and at the negative edge the switching means 110 opens. Between the positive and the negative edge of the signal the current controller 140 adjusts the current flowing through the load to a specific value, the current being detected by the measuring device 120.

During a first time period T1reg, the current is preferably adjusted to a higher value, and in a second phase to a lower value. For this purpose, the current evaluating device 135 identifies the actual current, flowing through the load 100, on the basis of the drop in voltage at the resistor 120. The current controller 140 compares the actual current II with the desired current IS. On the basis of this comparison, it produces an actuation signal Vtc to be supplied to the output stage 130 which then correspondingly actuates the switching means 110.

Furthermore, the output signal of the current controller 140 is processed by the filter 145. This filter produces a voltage value which is proportional to the pulse length of the output signal Vtc of the current controller 140.

While the armature of the solenoid valve moves, a voltage is induced in the coil of the solenoid valve. At the switching time the armature reaches its new limit position and the movement ends. This causes the induced voltage to disappear. The result of this is that the current flowing through the coil changes at this time. Thus, the pulse length changes at the switching time. By evaluating the pulse length, the switching time can be identified. The time window 150 permits this evaluation only within a specific time range after the actuation of the solenoid valve.

Figure 2:
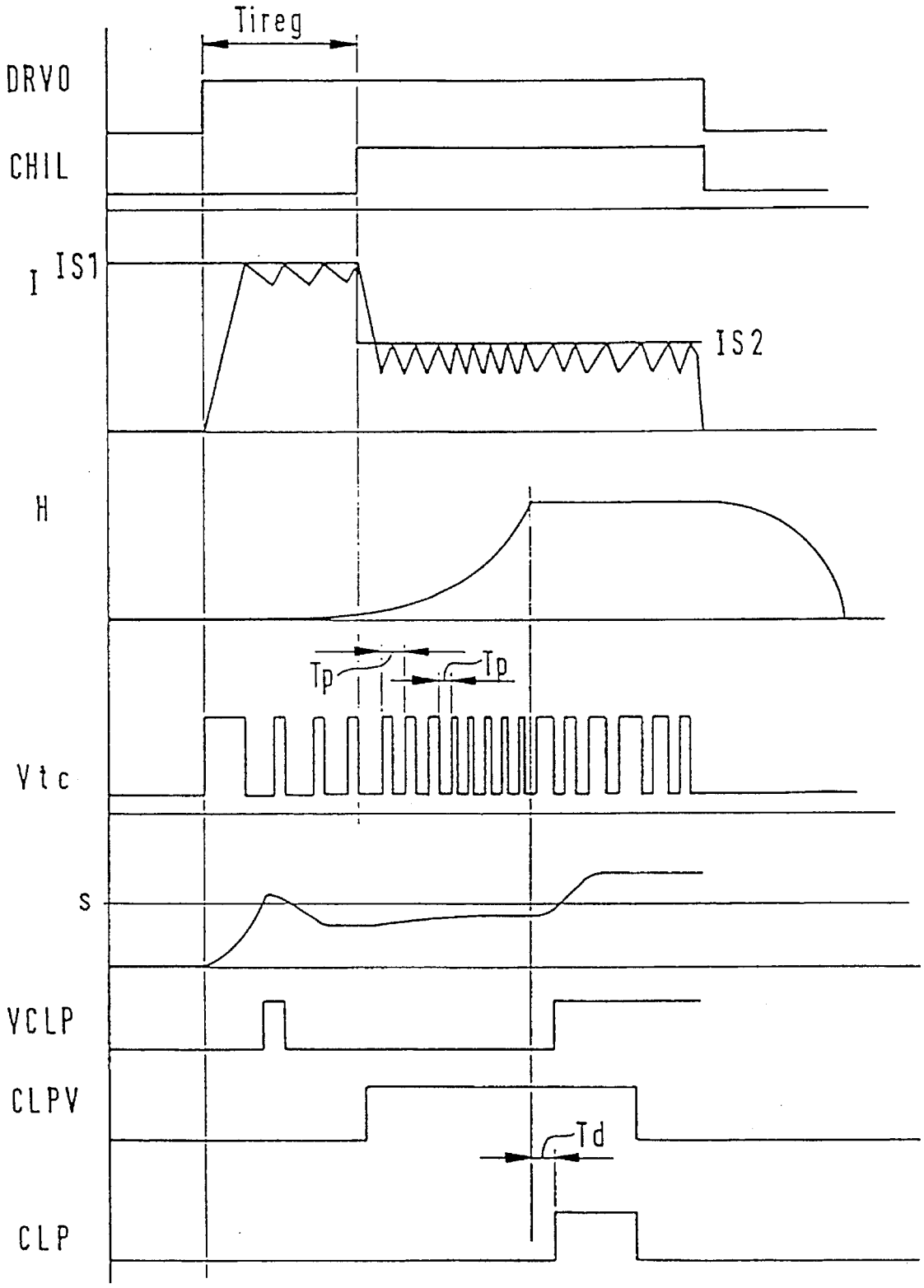
FIG. 2 shows various signals according to the present invention plotted over time.

For further explanation of the description please refer to FIG. 2 in which various signals According to the present Invention are plotted against time.

In the first line, the signal DRVO is plotted. This signal is transmitted to the output stage 130 by the control unit 155.

In the second line, the signal CHIL, which is also transmitted to the output stage 130 by the control unit 155 is plotted. While this signal is present, the current is adjusted to the second desired value.

In the third line, the current I, which flows through the solenoid valve, is plotted. In the fourth line, the travel H of the solenoid valve needle is indicated.

The fifth line shows the signal Vtc which corresponds to the output signal of the current controller 140. This signal also corresponds to the switching state of the switching means 110. At a low signal value the switch is opened and at a high signal value the switch is closed.

In the next line the filtered pulse length of this signal is plotted. This signal is only present internally in the filter 145. The seventh line shows the signal VCLP which assumes an increased value when the frequency exceeds a specific threshold value.

The next signal CLPV defines, with its increased signal value, the time window within which the switching time usually lies. This signal is transmitted to the time window 150 by the control unit. In the last line, the signal CLP whose positive edge defines the switching time is plotted.

If the output stage 130 receives a positive edge of the signal DRVO, the output stage 130 actuates the switching means 110 in such a way that the latter closes or specifies a desired value, different from zero, for the current I. This means that the output signal Vtc of the current controller 140 assumes an increased value.

Within a first time period, until the signal CHIL assumes a higher value, the current controller 140 adjusts the current flowing through the solenoid valve to a desired value IS1 prescribed by the control unit. This current controller is preferably realized as a two-point controller. The two-point controller opens the switching means 110 when an upper current threshold is exceeded. The lower current threshold is fluid and is achieved by deactivating the switching means for a specific time TP. This means that when the current value is exceeded the switch opens and after the prescribed time TP the switch closes again. The current I through the solenoid valve oscillates between a prescribed upper threshold and a lower value.

Briefly before the end of the time period T1reg, the solenoid valve needle begins its movement in the direction of its new limit position. The switching state of the switching means 110 or the output signal of the current controller alternates between its upper and lower signal value. At the start, the switching means is closed for a relatively long time. But during the first time period T1reg, the switch-off time TP is set such that a desired hysteresis of the two-point controller is obtained.

When the signal CHIL is present, the desired value which corresponds to the upper current threshold S1 drops to a smaller value. The desired value S1 in the first phase is referred to as the pickup current and the desired value S2 in the second phase is referred to as the holding current. The dropping of the desired value for the current takes place after the solenoid valve needle has begun to move.

This time is estimated by the control unit 155 as a function of various operating parameters. After this time has been reached, the control unit 155 outputs a signal CHIL, with a positive edge. Starting from the positive edge of the signal CHIL a switch-off time TP which is constant or becomes smaller in a linear way is prescribed so that a desired hysteresis or a satisfactory degree of precision of the switching time is obtained. If the switch-off time TP is reduced in the direction of the expected closing time in a linear or nonlinear way, this permits the precision or the sensitivity of the detection to be improved. An advantage of a variable switch-off time is a reduced power loss of the switching element 110 since the maximum switching frequency only occurs near to the switching time.

At the time at which the solenoid valve needle approaches its limit position, the pulse length of the signal Vtc changes suddenly. If the pulse length of the signal Vtc is now considered, a sudden change or rise in the pulse length is detected at the switching time. As soon as the filtered pulse length exceeds the threshold value S, the signal VCLP has a positive edge. In order to prevent incorrect detections, only a signal VCLP between the positive and the negative edges of the signal CLPV is detected as being acceptable.

In the case of an acceptable positive edge of the signal VCLP, a positive edge of the signal CLP is transmitted to the control unit 155. This positive edge characterizes the switching time of the solenoid valve. Owing to signal delays, the edge follows the actual switching time by the delay time Td. This delay time Td is a function of the filter and the switching frequency at the closing time and is taken into account by the control unit 155.

Alternatively, there also may be provision for the change in period length to be evaluated by a two-point controller with upper and lower thresholds if the current in the solenoid valve 100 can be measured directly. It is essential that a parameter which characterizes the switching state of the switching means 110 is evaluated. If the actuation signal of the switching means or the output parameter of the current controller 140 changes, the time of the change corresponds to the switching time of the electromagnetic load.

Figure 3:
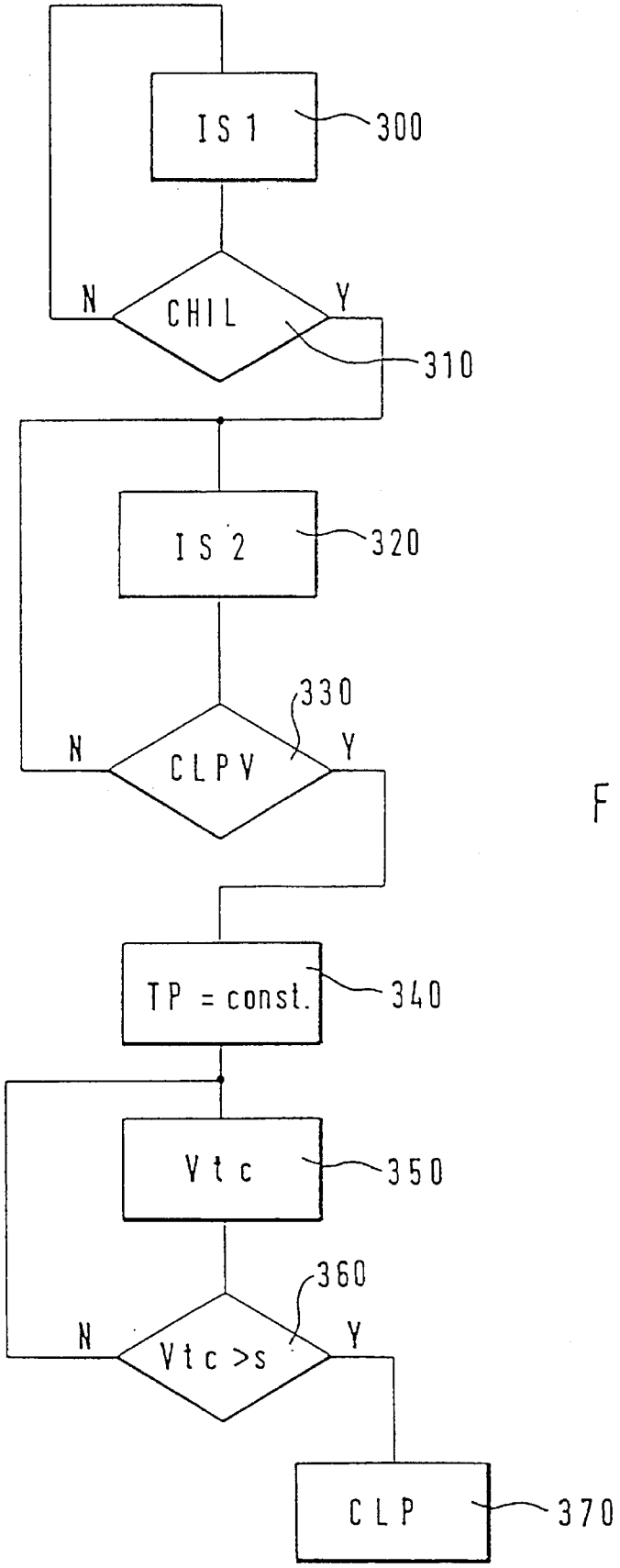
FIG. 3 shows a flow diagram of an exemplary method according to the present invention.

In order to clarify the method according to the present invention, reference will be made to the flow diagram according to FIG. 3. As soon as the positive edge of the signal DRVO occurs, the program begins at step 100. Here, the current is adjusted by the current controller 140 to a first desired value IS1.

The subsequent interrogation 310 tests whether the signal CHIL is present. If this is not the case, step 300 continues to be processed. If this signal is present, step 320 follows. In step 320, the current controller 140 adjusts the current to the second desired value IS2.

The subsequent interrogation 330 tests whether the signal CLPV is present. If this is not the case, the program continues with step 320. If the signal CLPV is present, step 340 follows. Here, a constant value is prescribed for TP. Subsequently, at step 350 the pulse length is determined from the signal Vtc and filtered. The interrogation 360 tests whether the filtered signal Vtc is larger than a threshold S. If this is not the case, step 350 takes place again, otherwise if the pulse length is longer than a threshold S the signal CLP is output.

Instead of controlling the current which flows through the load, there may be also provision for the voltage dropping at the load to be controlled.

What is claimed is:

1. A device for actuating an electromagnetic load to influence the metering of fuel in a diesel internal combustion engine, wherein the electromagnetic load is connected in series with a means for switching, the device comprising:

means for generating an actuation signal;

means for providing the actuation signal to the means for switching, the means for switching causing a current to flow through the electromagnetic load in response to the actuation signal provided to the means for switching;

means for evaluating a characterizing parameter of the actuation signal; and means for determining a switching time of the electromagnetic load as a function of the evaluation of the characterizing parameter.

2. A method for actuating an electromagnetic load to influence the metering of fuel in an internal combustion engine, wherein the electromagnetic load is connected in series with a switch, the method comprising the steps of:

generating an actuation signal to actuate the switch;

providing the actuation signal to the switch to cause a current to flow through the electromagnetic load in response to the actuation signal provided to the switch;

evaluating a characterizing parameter of the actuation signal; and determining a switching time of the electromagnetic load as a function of the evaluation of the characterizing parameter.

3. A method for actuating an electromagnetic load to influence the metering of fuel in a diesel internal combustion engine, wherein the electromagnetic load is connected in series with a means for switching, the method comprising the steps of:

generating an actuation signal;

providing the actuation signal to the means for switching to cause a current to flow through the electromagnetic load in response to the actuation signal provided to the means for switching;

evaluating a characterizing parameter of the actuation signal; and determining a switching time of the electromagnetic load as a function of the evaluation of the characterizing parameter.

4. The method according to claim 3, wherein the step of determining the switching time further includes the step of determining a time window, the switching time being detected during the time window.

5. The method according to claim 3, wherein the step of generating the actuation signal includes generating the actuation signal via a current controller, the current controller controlling the current through the electromagnetic load.

6. The method according to claim 3, wherein the electromagnetic load includes a solenoid valve.

7. The method according to claim 3, wherein the means for switching includes a transistor.

8. The method according to claim 7, wherein the transistor includes a field effect transistor.

9. The method according to claim 3, wherein the characterizing parameter includes one of a pulse length and a period length of the actuation signal.

10. The method according to claim 9, wherein the step of determining the switching time determines the switching time when one of the pulse length and the period length changes.

11. The method according to claim 10, wherein the step of determining the switching time determines the switching time when the change in one of the pulse length and the period length exceeds a threshold value.

* * * * *